US005460246A

United States Patent [19]

Burch et al.

[11] Patent Number: 5,460,246

[45] Date of Patent: Oct. 24, 1995

[54] ARTICULATED AERIAL LIFT

[75] Inventors: William Burch, Long Beach, Calif.; Raymond Fritel, Waco, Tex.; Paul Roloff, St. Charles, Mo.

[73] Assignee: O'Flaherty Finance, Waco, Tex.

[21] Appl. No.: 392,687

[22] Filed: Feb. 23, 1995

Related U.S. Application Data

[63] Continuation of Ser. No. 110,401, Aug. 23, 1993, abandoned.

[51] Int. Cl.[6] ..... B66F 11/04

[52] U.S. Cl. ..... 182/63; 182/2

[58] Field of Search ..... 182/2, 63

[56] References Cited

U.S. PATENT DOCUMENTS

| | | | |
|---|---|---|---|
| Re. 31,400 | 10/1983 | Rallis et al. | 182/2 |
| 3,575,262 | 4/1971 | Way | 182/2 |
| 3,708,037 | 1/1973 | Tranchero | 182/2 |
| 4,757,875 | 7/1988 | Hade, Jr. et al. | 182/2 |
| 4,775,029 | 10/1988 | MacDonald et al. | 182/2 |
| 5,082,085 | 1/1992 | Ream et al. | 182/2 |
| 5,249,643 | 10/1993 | Backer et al. | 182/2 |

FOREIGN PATENT DOCUMENTS

| | | | |
|---|---|---|---|
| 2228250 | 8/1990 | United Kingdom | 182/2 |

OTHER PUBLICATIONS

*American National Standard for boom–supported elevating work platforms,* American National Standards Institute, Inc., Jul. 17, 1980, pp. 1–12.

*Primary Examiner*—Alvin C. Chin-Shue
*Attorney, Agent, or Firm*—Arthur F. Zobal

[57] ABSTRACT

An articulated aerial lift has a platform that is coupled to one end of a boom. The other end of the boom is connected to an upper end of a riser. An arm couples the lower end of the riser to a turret. As the arm moves between a lowermost position to a raised position, the riser rotates between a forward position to a backward position in order to reduce an overturning moment caused by the platform. Rotation of the riser can be accomplished with nonparallel arms.

15 Claims, 4 Drawing Sheets

ARTICULATED AERIAL LIFT

This is a continuation of co-pending application Ser. No. 08/110,401 filed Aug. 23, 1993, now abandoned.

FIELD OF THE INVENTION

The present invention relates to aerial or boom lifts and more particularly to methods and apparatuses for stabilizing aerial lifts.

BACKGROUND OF THE INVENTION

Aerial lifts have a platform or bucket for supporting a human. The platform is connected to a turret by a boom. The platform can be raised to an elevated position or lowered to the ground. In addition, the platform can be swung clockwise or counterclockwise by rotating the turret about a chassis. The boom is typically telescoping so as to allow extension and retraction of the platform.

In prior art articulated aerial lifts, the boom is articulated with respect to the turret by way of parallel arms. The arms are connected to the boom by a riser. Articulation allows a wider operating range (or envelope) for the platform than is available for unarticulated or stick boom lifts.

In aerial lifts, stability is important. An unstable lift can overturn, wherein the lift (platform, boom and all) literally falls over. Overturning endangers those persons located on the platform as well as those persons located on the ground and adjacent to the lift.

Stability of a lift must be achieved in all positions of the platform. Two of the most critical platform positions are referred to as the worst forward stability position and the worst backward stability position. In the worst forward stability position, the arms are fully raised and the boom is horizontal and fully extended. This position produces the largest overturning moment when the platform is in the forward position. Stability in the worst forward stability position is achieved by adding counterweights to the back end of the turret or to the chassis. The counterweights provide a stabilizing moment.

In the worst backward stability position, the boom is raised to its maximum elevation and is fully retracted. The arms are in their lowermost position. In the worst backward stability position, the platform is located near or even behind a vertical axis extending through the turret. The counterweights used to provide stability in the worst forward stability position no longer serve to counter balance the platform, but instead add to the weight of the platform. This produces an overturning moment. Stability for the worst backward stability position is achieved by adding counterweights to the turret or the chassis in the correct location.

Stabilizing both positions (worst forward and backward stability positions) determines the total weight of the lift. It is desired to minimize the total weight so as to reduce the cost of the lift and to allow use of the lift in areas where weight restrictions apply.

Overall lift weight could be reduced by not allowing the platform to reach the worst forward stability position because this is not a useful position. This could be done by using switches, sensors and valves to limit boom extensions below a certain angle. However, these devices could fail, allowing an operator to unwittingly reach an unstable position.

SUMMARY OF THE INVENTION

It is an object of the present invention to provide an aerial lift that has stability in all positions of its platform with a reduced amount of weight.

The aerial lift has a boom with first and second ends. A platform is coupled to the boom second end. A riser has first and second ends. The riser second end is coupled to the boom first end. An arm extends between the riser first end and a turret. The arm is moveable between an arm first position and an arm second position. The riser second end is moveable with respect to the riser first end as the arm moves between the arm first position and the arm second position. The riser second end is in a riser first position when the arm is in the arm first position and the riser second end is in a riser second position when the arm is in the arm second position.

In one aspect of the present invention, there is a means for pivoting the riser second end about the riser first end as the arm is moved between the arm first and second positions.

In still another aspect of the present invention, the arm is a first arm and the means for pivoting the riser second end about the riser first end further comprises a second arm extending between the riser first end and the turret. The second arm is nonparallel to the first arm.

There is a method of articulating an aerial lift, which lift includes a boom, a platform connected to a second end of the boom, a riser connected to a first end of the boom and an arm connected to an end of the riser. The arm is rotated in a first direction about a turret. As the arm is rotated, the riser is rotated in a direction that is opposite of said first direction so as to reduce an overturning moment produced by said platform.

The present invention provides for stability of the lift when the platform is in a worst stability position (such as forward stability or backward stability), while minimizing the need for providing offsetting counterweights, By pivoting or rotating the riser in a forward direction (towards the turret) as the arms are brought to the worst backward stability position, the platform is maintained in a forward position so as to reduce the overturning moment that is caused by the platform. In addition, by pivoting or rotating the riser in a backward direction (away from the turret) as the arms are brought to the worst forward stability position, the platform is maintained in a forward position so as to reduce the overturning moment that is caused by the platform. Thus, the need for offsetting counterweights is minimized.

DESCRIPTION OF THE PREFERRED EMBODIMENT

Figure 1:
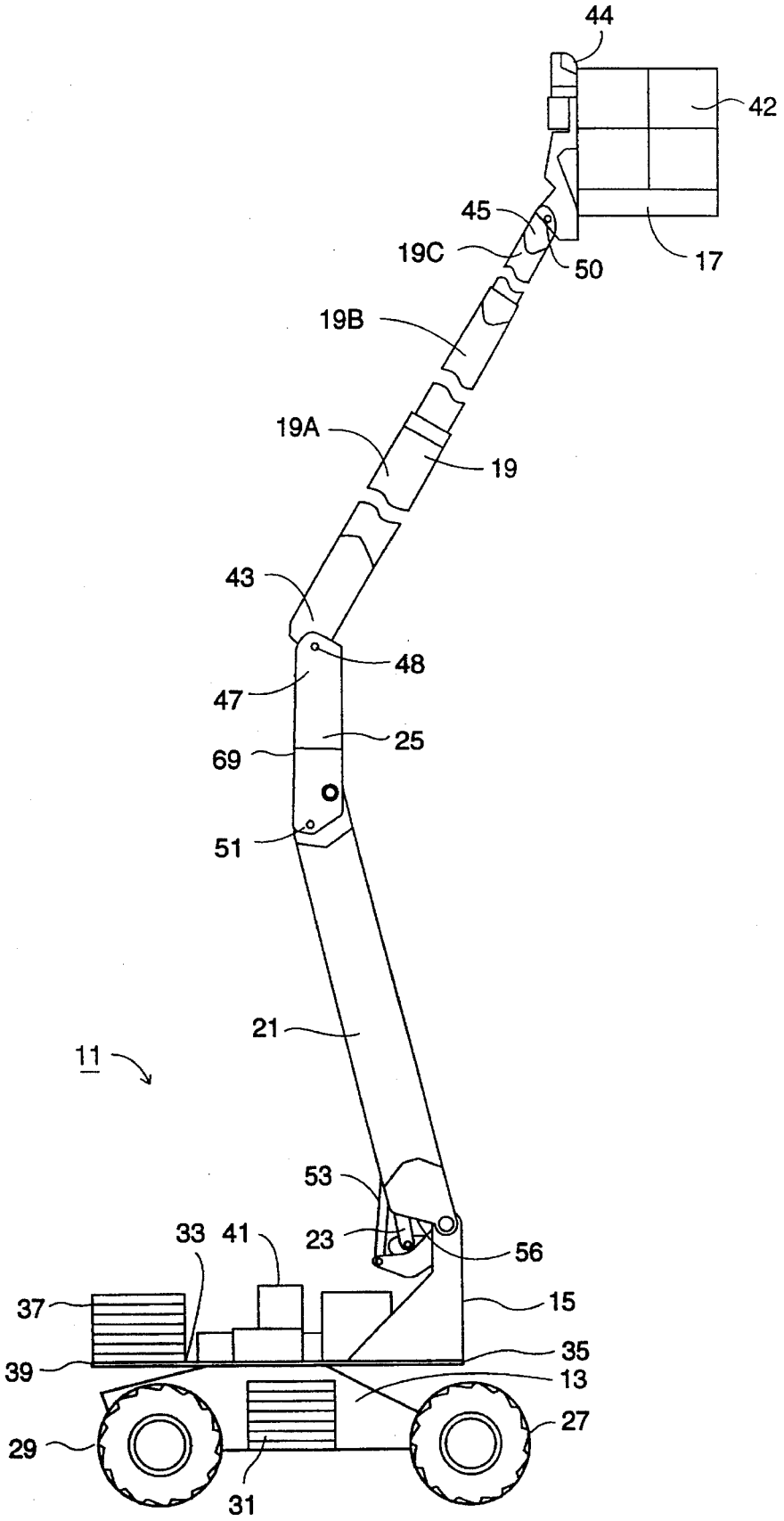
FIG. 1 is a side elevational view of the aerial lift of the present invention, in accordance with a preferred embodiment, shown with the arms fully raised.

In FIG. 1, there is shown a side view of the aerial lift 11 of the present invention, in accordance with a preferred embodiment. The lift includes a chassis 13, a turret 15, a platform 17, a boom 19, arms 21, 23, and a riser 25.

The chassis 13 is conventional, having two front wheels 27 and two rear wheels 29. The chassis 13 also has internal counterweights 31. The counterweights 31 are in the form of stacked steel plates securely mounted to the chassis. The chassis 13 is self-propelled so as to allow movement of the lift 11 from one place to another. Therefore, the chassis contains drive machinery to propel the lift.

Mounted on top of the chassis 13 is a turret platform 33. The turret 15 is mounted to and protrudes upwardly from a front corner 35 of the turret platform 33. Counterweights 37, similar to the chassis counterweights 31, are located at the rear end 39 of the turret platform 33. Also located on the turret platform 33 are the hydraulic systems 41 and control systems for providing movement to the boom 19 and arms 21, 23.

The platform 17 has a guardrail 42 around its periphery. In addition, there is provided a control panel 44 for the operator who is standing on the platform 17 to access in order to control the movement and positioning of the platform. The platform 17 is connected to the turret 15 by way of the boom 19, the riser 25 and the arms 21, 23.

The boom 19 has first and second ends 43, 45. The first end 43 of the boom 19 is pivotally connected to the upper end 47 of the riser 25 by a pin type coupling 48. The platform 17 is pivotally connected to the second end 45 of the boom 19 by a pin type coupling 50. The boom 19 has plural segments 19A, 19B, 19C and is of the telescoping type, so that its length (between the riser and the platform) can be extended and retracted. A hydraulic cylinder 49 (see FIG. 4) is connected between the riser 25 and the boom 19 so as to pivot the boom about the upper end 47 of the riser.

Figure 3:
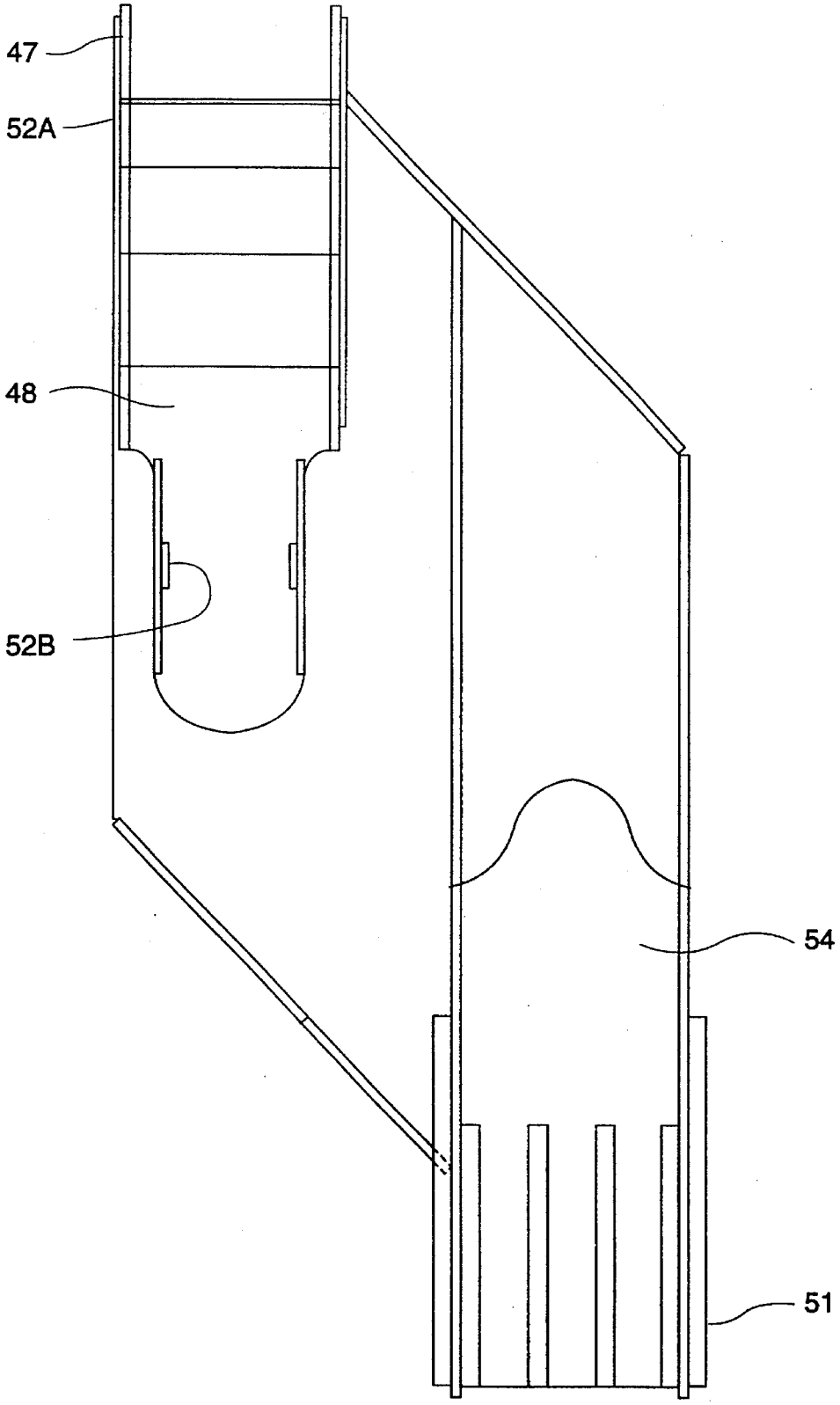
FIG. 3 is an end view of the riser.

The riser 25 has upper and lower ends 47, 51 which are laterally offset as shown in the end view of FIG. 3. The arms 21, 23 are coupled to the lower end 51 of the riser 25. The offset of the riser ends 47, 51 allows the boom and the arms to be lowered to a side by side position. The upper end 47 of the riser is provided with a cavity 48 for receiving the first end 43 of the boom and the hydraulic cylinder 49. A connection point 52A is provided for the boom 19, while another connection point 52B is provided for the hydraulic cylinder 49. The lower end 51 of the riser also has a cavity 54 for receiving the arms 21, 23.

There are provided two arms to couple the riser 25 to the turret 15. There is a compression arm 21 and a tension arm 23. The compression arm 21 is a hollow rectangle in transverse cross-section. The ends of the compression arm 21 are open so that the hollow interior of the compression arm forms a conduit for receiving hoses and other components. The hoses extend from the hydraulic system 41 on the turret platform up to the control panel 44 (see FIG. 1). The interior of the compression arm also receives the tension arm 23. The tension arm 23 extends from the turret to the riser. Notches 56 are formed in the ends of the compression arm 21 so that the compression arm can pivot with respect to the riser and the turret. A hydraulic cylinder 53 is coupled between the turret 15 and the compression arm 21.

Figure 2:
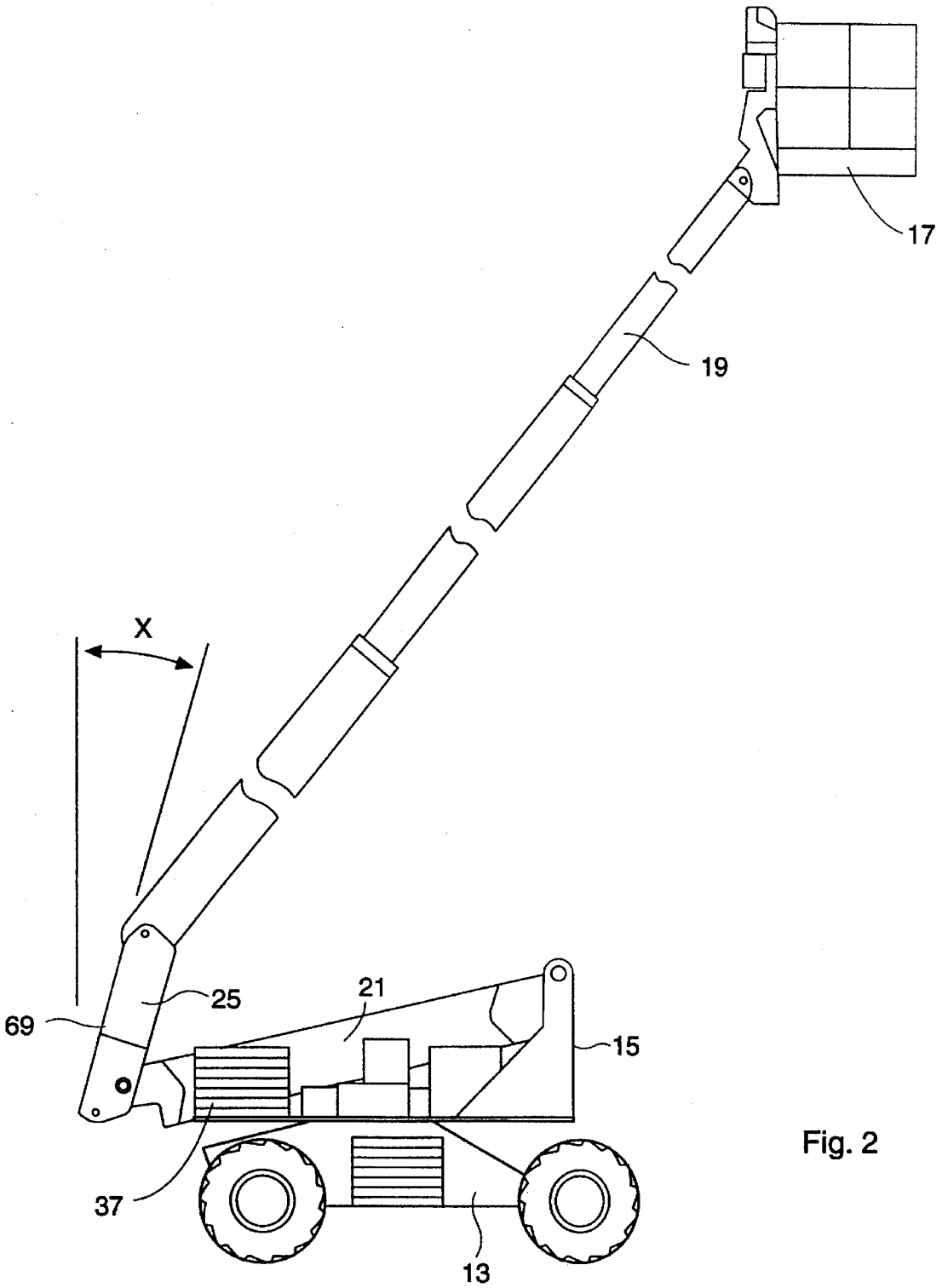
FIG. 2 shows the aerial lift of FIG. 1 with arms fully lowered.

With its hydraulic system, the platform 17 can be moved to a variety of positions. The boom 19 can be extended or retracted to position the platform in a desirable location. In addition, the boom 19 can be raised or lowered relative to the riser 25, wherein the hydraulic cylinder 49 (see FIG. 4) is employed. The boom can be articulated between a stowed position, wherein the boom is adjacent to the arms, and a raised position, wherein the boom is as shown in FIGS. 1 and 2. The arms may be raised or lowered, wherein the arm hydraulic cylinder 53 is employed. The arms 21,23 move in unison. Thus, as the hydraulic cylinder 53 moves the compression arm 21, the tension arm 23 follows. The arms move between a lowered position, shown in FIG. 2, and a raised position, shown in FIG. 1. As the platform moves, it is maintained in a level orientation by a hydraulic cylinder (not shown) that is coupled between the platform and the boom.

The riser 25 pivots between a backward position (shown in FIG. 1) and a forward position (shown in FIG. 2). ("Forward" and "backward" are used with respect to the turret 15. Using the orientation of FIGS. 1, 2 and 4, forward is to the right of the Figures and backward is to the left. Forward rotation is shown as clockwise rotation and backward rotation is shown as counterclockwise rotation.)

The movement of the riser 25 between forward and backward positions will now be explained. One end of each arm has a first connection point 61, 63 while the other end of each arm has a second connection point 65, 67. The first connection point 61, 63 of each arm is pivotally coupled to the turret 15, while the second connection point 65, 67 of each arm is pivotally coupled to the riser 25. Pin type couplings are used at the connection points. An imaginary line extending through the center of the first and second connection points 61, 65 of the compression arm 21 is slightly nonparallel to an imaginary line extending through the center of the first and second connection points 63, 67 of the tension arm 23. This is because, in the preferred embodiment, the distance between the connection points 65, 67 at the riser is less than the distance between the connection points 61, 63 at the turret. This nonparallel configuration of the arms 21, 23 greatly aids in the stability of the aerial lift when the platform 19 is in the worst backward stability position.

When the arms 21, 23 are in their highest position, as shown in FIG. 1, (that is, the arms, which move together, have been raised from the stowed position shown in FIG. 2 in a clockwise direction) the riser 25 is in a backward position. In FIG. 1, this is demonstrated by the rear surface 69 of the riser being vertical. When the arms are at their highest position, the platform is located in front of (or to the right of, using the orientation of FIG. 1) a vertical axis that extends through the turret 15. The turret counterweights 37 thus properly balance the platform and overturning of the lift 11 is not a danger.

Figure 4:
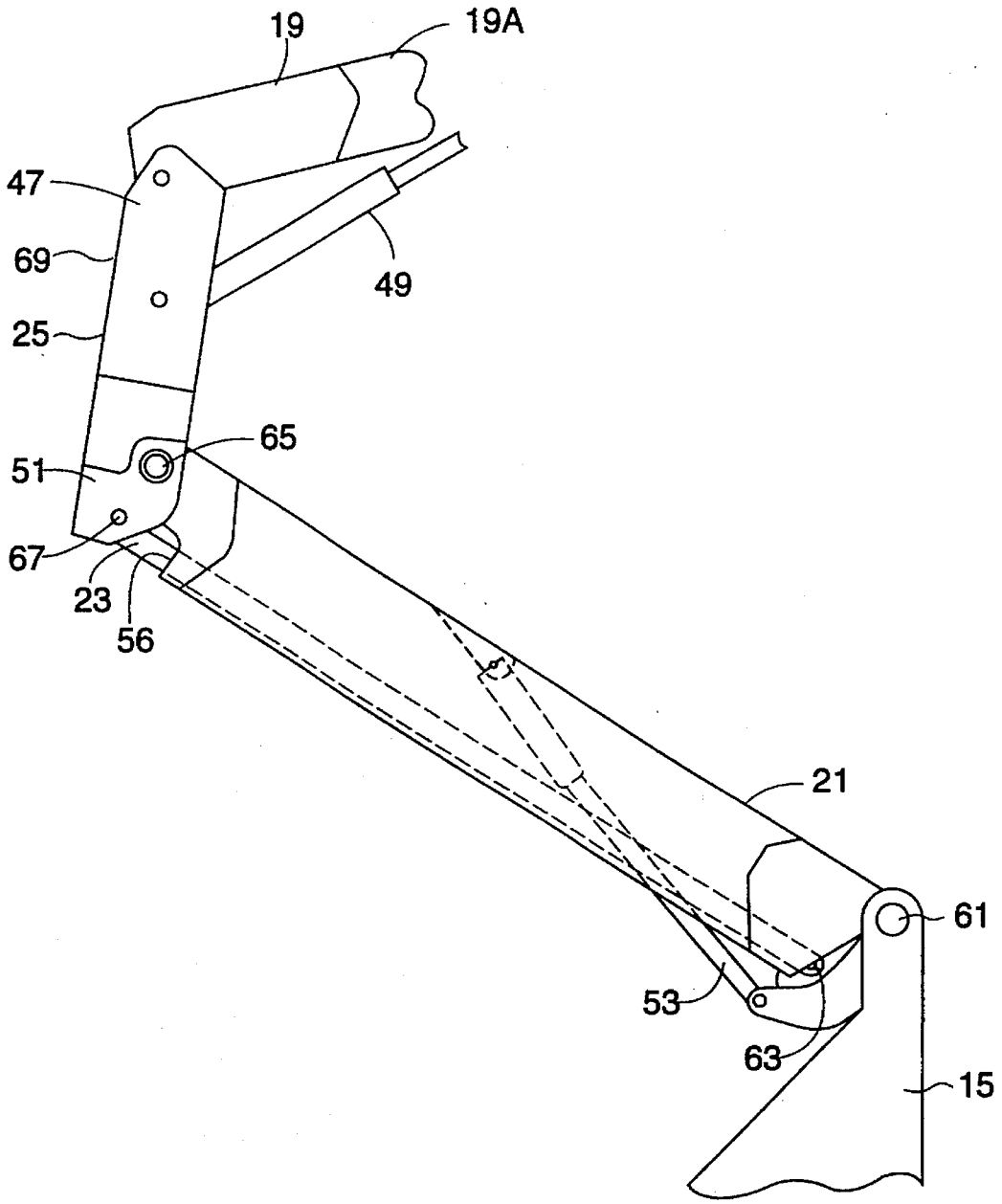
FIG. 4 is a side elevational view of the arms and the riser, shown with the arms located between the fully lowered and the fully raised positions.

As the arms 21, 23 are lowered from their highest position, the arms cause the upper end 47 of the riser to pitch or pivot forward (in a clockwise direction using the orientation of FIG. 1) relative to the lower end 51 (see FIG. 4). This is demonstrated by the rear surface 69 of the riser forming an angle with the vertical.

As the arms 21, 23 continue to be lowered to their lowest position, as shown in FIG. 2, the arms continue to pivot the upper end 47 of the riser in a forward direction about the lower end 51. This is demonstrated by the rear surface 69 of the riser forming an even greater angle X with the vertical. In FIG. 2, the riser is in the forward position.

The configuration shown in FIG. 2, where the arms are at their lowest position and the boom is fully retracted, is the worst backward stability position. The forward position of the riser 25 decreases the overturning moment produced by the platform in the worst backward stability position, because the platform is kept forward. Thus, the platform continues to be properly counterbalanced by the turret counterweights 37.

With the arms in their lowermost position, as shown in FIG. 2, the boom can be extended and retracted to raise and lower the platform 17. The riser maintains its forwardly pitched orientation, regardless of boom extension. Thus, when the boom is retracted so the platform is in the worst backward stability position, the platform remains on the forward side of the turret.

In prior art lifts, the riser maintains its vertical orientation at all orientations of the arms. Thus, with the arms in their lowermost position, the platform would be located more rearwardly, thereby producing a larger overturning moment than is produced by the present invention. Counterweights, which would be in addition to the turret counterweights 37, would be necessary to stabilize such a prior art lift.

As the platform moves to the worst forward stability position, the riser rotates to its backward position (see FIG. 1). This effectively reduces the side reach of the lift, wherein the overturning moment produced by the platform in the worst forward stability position is reduced.

Thus, the riser rotates in an opposite direction from the arms, in order to provide increased stability. As the arms rotate clockwise about the turret 15, the riser rotates counterclockwise to pull the platform backward. As the arms rotate counterclockwise about the turret, the riser rotates clockwise to push the platform forward.

With the present invention, the total weight of the lift is reduced over prior art lifts. This is because when the platform is in the worst backward stability position, it is still counterbalanced by the same counterweights that are used to provide stability in the worst forward stability position. In the preferred embodiment, where the reach of the lift is 86 feet, a weight savings of 12,000 pounds has been realized.

Although the present invention has discussed the use of nonparallel arms to rotate the riser, other means to rotate the riser could be used. For example, a hydraulic cylinder coupled to the compression arm and to the riser would provide suitable actuation of the riser between its forward and backward positions. The hydraulic cylinder would be controlled by the arm hydraulic system, operating as the arm was raised and lowered. In addition, gears could be used to rotate the riser. A level sensor and a microprocessor would control the direction of riser rotation and coordinate riser rotation with arm movement.

The foregoing disclosure and the showings made in the drawings are merely illustrative of the principles of the present invention and should not be interpreted in a limiting sense.

We claim:

1. An aerial lift, comprising:

a turret having a front end and a rear end, a first arm having first and second ends, a second arm having first and second ends, a riser having first and second ends, a boom having first and second ends, a platform coupled to said second end of said boom, means for pivotally coupling said first end of said boom to said second end of said riser for pivotal movement about a riser pivot point, first and second pivot means for pivotally coupling said first ends of said first and second arms to said turret for pivotal movement about first and second spaced apart pivot points respectively which are fixed relative to each other, third and fourth pivot means for pivotally coupling said first end of said riser to said second ends of said first and second arms for pivotal movement about third and fourth spaced apart pivot points respectively which are fixed relative to each other, said first and third pivot points being fixed relative to each other and said second and fourth pivot points being fixed relative to each other, said first and third pivot points and said second and fourth pivot points being located such that a straight line extending between said first and third pivot points is non-parallel to a straight line extending between said second and fourth pivot points, means coupled to said turret and said first arm for pivoting said first arm and hence said second arm about said first and second pivot points respectively, for moving said first arm and hence said second arm between a forward up position and a rearward down position wherein an angle is formed between a line extending between said first and third pivot points and a line extending between said third pivot point and said riser pivot point which is an obtuse angle when said first and second arms are in a forward up position and an acute angle when said first and second arms are in a rearward down position, with said second end of said riser being located forward of said first end of said riser when said first and second arms are in a rearward down position, and means coupled to said riser and said boom for pivoting said first end of said boom about said riser pivot point for moving said boom relative to said riser.

2. The aerial lift of claim 1, comprising:

a turret platform for supporting said turret wherein the distance between said first pivot point and said turret platform is greater than the distance between said second pivot point and said turret platform, and means for moveably supporting said turret platform and said turret on the ground.

3. The aerial lift of claim 1, wherein:

the distance between said first and second pivot points is greater than the distance between said third and fourth pivot points.

4. The aerial lift of claim 3, wherein:

the distance between said first and third pivot points is greater than the distance between said second and fourth pivot points.

5. The aerial lift of claim 2, wherein:

the distance between said first and third pivot points is greater than the distance between said second and fourth pivot points.

6. An aerial lift, comprising:

a turret having a front end and a rear end, a first and having first and second ends, a second arm having first and second ends, a riser having first and second ends, a boom having first and second ends, a platform coupled to said second end of said boom, means for pivotally coupling said first end of said boom to said second end of said riser for pivotal movement about a riser pivot point, first and second pivot means for pivotally coupling said first ends of said first and second arms to said turret for pivotal movement about first and second spaced apart pivot points respectively which are fixed relative to each other, third and fourth pivot means for pivotally coupling said first end of said riser to said second ends of said first and second and for pivotal movement about third and fourth spaced apart pivot points respectively which are fixed relative to each other, said first and third pivot points being fixed relative to each other and said second and fourth pivot points being fixed relative to each other, means coupled to said turret and said first arm for pivoting said first arm and hence said second arm about said first and second pivot points respectively, for moving said first arm and hence said second arm between a forward up position and a rearward down position wherein an angle is formed between a line extending between said first and third pivot points and a line extending between said third pivot point and said riser pivot point which is an obtuse angle when said first and second arms are in a forward up position and an acute angle when said first and second arms are in a rearward down position, with said second end of said riser being located forward of said first end of said riser when said first and second arms are in a rearward down position, and means coupled to said riser and said boom for pivoting said first end of said boom about said riser pivot point for moving said boom relative to said riser, the distance between said first and second pivot points is greater than the distance between said third and fourth pivot points.

7. The aerial lift of claim 6, wherein:

the distance between said first and third pivot points is greater than the distance between said second and fourth pivot points.

8. An aerial lift, comprising:

a turret having a front end and a rear end, a turret platform for supporting said turret, means for moveably supporting said turret platform and said turret on the ground, a first elongated arm having first and second ends, a second elongated arm having first and second ends, an elongated riser having first and second ends, a boom having first and second ends, a platform coupled to said second end of said boom, means for pivotally coupling said first end of said boom to said second end of said riser for pivotal movement about a riser pivot point, first and second pivot means for pivotally coupling said first ends of said first and second arms to said turret for pivotal movement about first and second spaced apart pivot points respectively which are fixed relative to each other with said second pivot point being located rearward of said first pivot point, the distance between said first pivot point and said turret platform being greater than the distance between said second pivot point and said turret platform, third and four pivot means for pivotally coupling said first end of said riser to said second ends of said first and second arms for pivotal movement about third and fourth spaced apart pivot points respectively which are fixed relative to each other, said first and third pivot points being fixed relative to each other and said second and fourth pivot points being fixed relative to each other, said first and third pivot points and said second and fourth pivot points being located such that a straight line extending between said first and third pivot points is non-parallel to a straight line extending between said second and fourth pivot points, means coupled to said turret and said first arm for pivoting said first arm and hence said second arm about said first and second pivot points respectively, for moving said first arm and hence said second arm between a forward up position and a rearward down position wherein the height of said third pivot point relative to said platform is greater than the height of said fourth pivot point relative to said platform when said first and second arms are in said forward up and rearward down positions and the distance between said first pivot point and said fourth pivot point is greater when said first and second arms are in said rearward down position than when said first and second arms are in said forward up position, and said fourth pivot point is rearward of said third pivot point with said second end of said riser being located forward of said first end of said riser when said first and second arms are in said rearward down position, and means coupled to said riser and said boom for pivoting said first end of said boom about said riser pivot point for moving said boom relative to said riser.

9. The aerial lift of claim 8, wherein:

an angle is formed between a line extending between said first and third pivot points and a line extending between said third pivot point and said riser pivot point which is an obtuse angle when said first and second arms are in a forward up position and an acute angle when said first and second arms are in a rearward down position.

10. The aerial lift of claim 8, wherein:

the distance between said first and second pivot points is greater than the distance between said third and fourth pivot points.

11. The aerial lift of claim 10, wherein:

the distance between said first and third pivot points is greater than the distance between said second and fourth pivot points.

12. The aerial lift of claim 9, wherein:

the distance between said first and third pivot points is greater than the distance between said second and fourth pivot points.

13. The aerial lift of claim 10, wherein:

the distance between said first and third pivot points is greater than the distance between said second and fourth pivot points.

14. An aerial lift, comprising:

a turret having a front end and a rear end, a turret platform for supporting said turret, means for moveably supporting said turret platform and said turret on the ground, a first elongated arm having first and second ends, a second elongated arm having first and second ends, an elongated riser having first and second ends, a boom having first and second ends, a platform coupled to said second end of said boom, means for pivotally coupling said first end of said boom to said second end of said riser for pivotal movement about a riser pivot point, first and second pivot means for pivotally coupling said first ends of said first and second arms to said turret for pivotal movement about first and second spaced apart pivot points respectively which are fixed relative to each other with said second pivot point being located rearward of said first pivot point, the distance between said first pivot point and said turret platform being greater than the distance between said second pivot point and said turret platform, third and four pivot means for pivotally coupling said first end of said riser to said second ends of said first and second arms for pivotal movement about third and fourth spaced apart pivot points respectively which are fixed relative to each other, said first and third pivot points, being fixed relative to each other and said second and fourth pivot points being fixed relative to each other, means coupled to said turret and said first arm for pivoting said first arm and hence said second arm about said first and second pivot points respectively, for moving said first arm and hence said second arm between a forward up position and a rearward down position wherein the height of said third pivot point relative to said platform is greater than the height of said fourth pivot point relative to said platform when said first and second arms are in said forward up and rearward down positions and the distance between said first pivot point and said fourth pivot point is geater when said first and second arms are in said rearward down position than when said first and second arms are in said forward up position, and said fourth pivot point is rearward of said third pivot point with said second end of said riser being located forward of said first end of said riser when said first and second arms are in said rearward down position, and, means coupled to said riser and said boom for pivoting said first end of said boom about said riser pivot point for moving said boom relative to said riser, the distance between said first and second pivot points is greater than the distance between said third and fourth pivot points.

15. The aerial lift of claim 14, wherein:

the distance between said first and third pivot points is greater than the distance between said second and fourth pivot points.

* * * * *